US007985019B2

(12) United States Patent
Lundgren et al.

(10) Patent No.: US 7,985,019 B2
(45) Date of Patent: Jul. 26, 2011

(54) METHOD AND AN APPARATUS FOR THE CONTINOUS MIXING OF TWO FLOWS

(75) Inventors: Eric Lundgren, Ystad (SE); Bengt Palm, Genarp (SE)

(73) Assignee: Tetra Laval Holdings & Finance SA, Pully (CH)

( * ) Notice: Subject to any disclaimer, the term of this patent is extended or adjusted under 35 U.S.C. 154(b) by 1343 days.

(21) Appl. No.: 10/551,950

(22) PCT Filed: Apr. 8, 2004

(86) PCT No.: PCT/SE2004/000567

§ 371 (c)(1),
(2), (4) Date: Sep. 20, 2006

(87) PCT Pub. No.: WO2004/089522

PCT Pub. Date: Oct. 21, 2004

(65) Prior Publication Data

US 2007/0153625 A1 Jul. 5, 2007

(30) Foreign Application Priority Data

Apr. 8, 2003 (SE) ..... 0301028

(51) Int. Cl.
*B01F 5/04* (2006.01)

(52) U.S. Cl. ..... 366/162.4; 366/173.1; 366/175.2

(58) Field of Classification Search ..... 366/181.5, 366/336–340, 176.1–176.4, 162.4–162.5, 366/173.1, 173.2, 174.1, 175.2; 137/896
See application file for complete search history.

(56) References Cited

U.S. PATENT DOCUMENTS

| | | | | |
|---|---|---|---|---|
| 2,821,346 | A * | 1/1958 | Fisher | 241/39 |
| 4,261,521 | A * | 4/1981 | Ashbrook | 241/5 |
| 4,764,283 | A * | 8/1988 | Ashbrook et al. | 210/695 |
| 4,957,626 | A * | 9/1990 | Ashbrook et al. | 210/695 |
| 5,435,913 | A * | 7/1995 | Ashbrook | 210/188 |
| 7,087,178 | B2 * | 8/2006 | Romanyszyn et al. | 210/787 |
| 7,661,872 | B2 * | 2/2010 | Daniels et al. | |
| 7,901,128 | B2 * | 3/2011 | Gehrke et al. | |
| 2007/0153625 | A1 * | 7/2007 | Lundgren et al. | 366/144 |

FOREIGN PATENT DOCUMENTS

| | | |
|---|---|---|
| JP | 1-258734 | * 10/1989 |
| SE | 508137 C2 | 8/1998 |

* cited by examiner

*Primary Examiner* — Charles E Cooley
(74) *Attorney, Agent, or Firm* — Buchanan Ingersoll & Rooney PC

(57) ABSTRACT

A method and an apparatus for continuously mixing two flows, a first, larger flow and a second, smaller flow. The second flow is introduced counter-directed into the first flow. The apparatus comprises a T pipe where a first connection constitutes an inlet for the first flow. A second connection, at 180° in relation to the first connection, constitutes an inlet for the second flow. The second flow is led into the first flow through a conduit within the T pipe. The first connection is provided with a conical portion in which are provided a number of holes, so that the first flow is throttled and divided up into a plurality of subflows immediately before the mixing operation. A third connection is oriented at 90° in relation to the other connections and constitutes an outlet for the intermixed flows, which implies that the intermixed flows are caused to change direction immediately after the mixing.

16 Claims, 1 Drawing Sheet

METHOD AND AN APPARATUS FOR THE CONTINOUS MIXING OF TWO FLOWS

TECHNICAL FIELD

Figure 1:
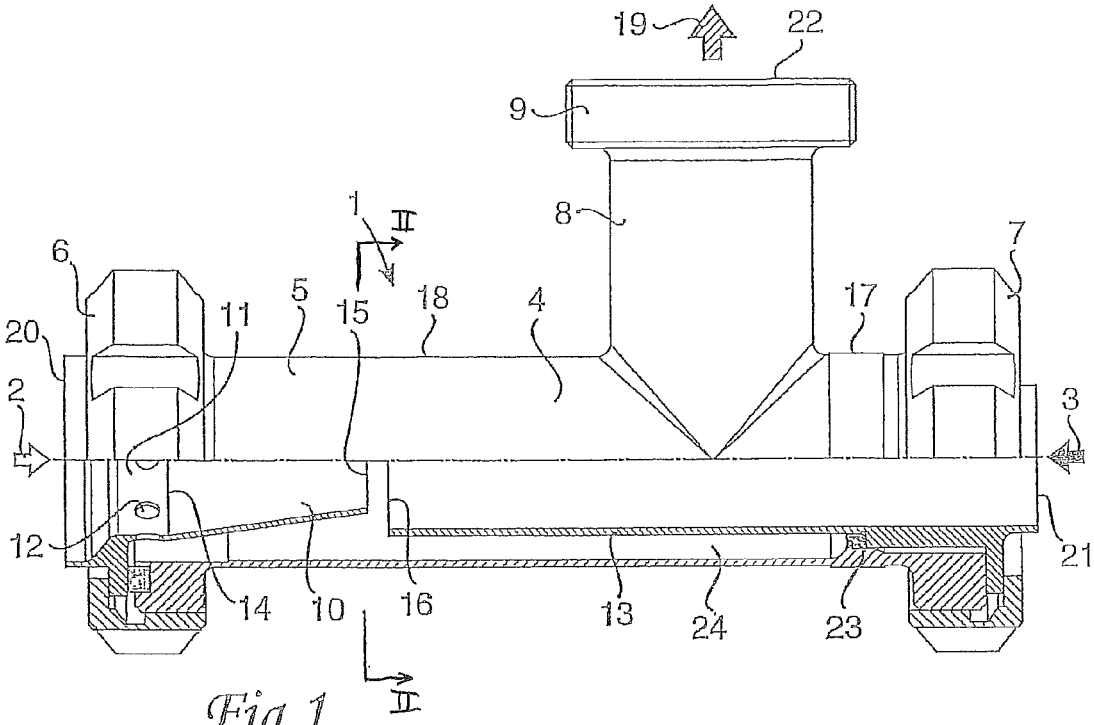

The present invention relates to a method for continuously mixing two flows which consist of a first, larger flow and a second, smaller flow, where the second flow is introduced into the first flow in a direction opposite to that of the first flow, and the mixed flows are caused to change flow direction immediately after the mixing.

The present invention also relates to an apparatus for continuously mixing two flows, the flows consisting of a first, larger flow and a second, smaller flow, and the apparatus comprising a T pipe where a first connection constitutes an inlet for the first flow and a second connection, at 180° in relation to the first, constitutes an inlet for the second flow, the second flow being led into the first flow through a conduit within the T pipe, and a third connection, at 90° in relation to the two other connections, constituting an outlet for the mixed flows.

BACKGROUND ART

In the production of drinks, such as fruit juices, nectar and still drinks (non carbonated soft drinks) and the like, the intention is often to mix two or more flows with one another. The different flows often are of different character and, for example, may consist of juice concentrate which is mixed with water or sugar solution which is mixed with fruit juice, etc. In order to ensure that the desired mixture is obtained, the sugar content is measured after the mixing operation. The sugar content is measured in °Brix with the aid of a refractometer. In order that the Brix value of the product be as reliable as possible, the mixture must be as homogeneous as possible before the product reaches the refractometer.

In most countries, juices and nectars have a statutory minimum Brix content in order to be sold under each respective name. If there is an insufficient mixture and, as a result, an unreliable Brix value in the subsequent measurement, it must be ensured that there is a margin to the lowest permitted Brix value, which involves increased raw materials costs.

The mixing operation may be put into effect in different ways. A previously common method is to batchwise mix in a tank with an agitator. This method is both costly and takes up considerable space. Another method is to carry out the mixing operation in a so-called static mixer where the two flows are caused to pass through an apparatus with a number of inclined plates or panels. These give rise to turbulence in the flows, which results in a mixture of the different flows. However, this method has proved not to be entirely reliable when there are major differences in viscosity in the flows.

Two further similar methods are described in Patent Specifications SE 508 137 and SE 0103591-4. These methods are completely continuous and entail that a smaller flow is led into a larger flow in such a manner that both of the flows are counter-directed. These methods give a good mixture, but for certain practical applications higher demands are placed, such as, for example, the mixing of juice concentrate with fibres, where there is a risk that the fibres fasten in narrow parts of the apparatuses. A number of practical applications also place extremely high demands on hygiene which must be met, at the same time as the intention is to realise as thorough a mixing as possible.

OBJECTS OF THE INVENTION

One object of the present invention is to realise a method and an apparatus where it is possible to mix juice concentrate with fibres, without the risk that fibres fasten anywhere in the apparatus.

A further object of the present invention is to realise an apparatus which affords improved cleaning possibilities than other apparatuses and where it is thus possible to place higher demands on the level of hygiene.

Solution

These and other objects have been attained according to the present invention in that the method of the type described by way of introduction has been given the characterising feature that the first flow is throttled and divided into several subflows immediately before the mixing operation.

These and other objects have also been attained according to the present invention in that the apparatus of the type described by way of introduction has been given the characterising feature that the first connection for the first flow is provided with a conical throttle in which a number of holes are provided.

Preferred embodiments of the present invention have further been given the characterising features as set forth in the appended subclaims.

BRIEF DESCRIPTION OF THE ACCOMPANYING DRAWINGS

Figure 2:
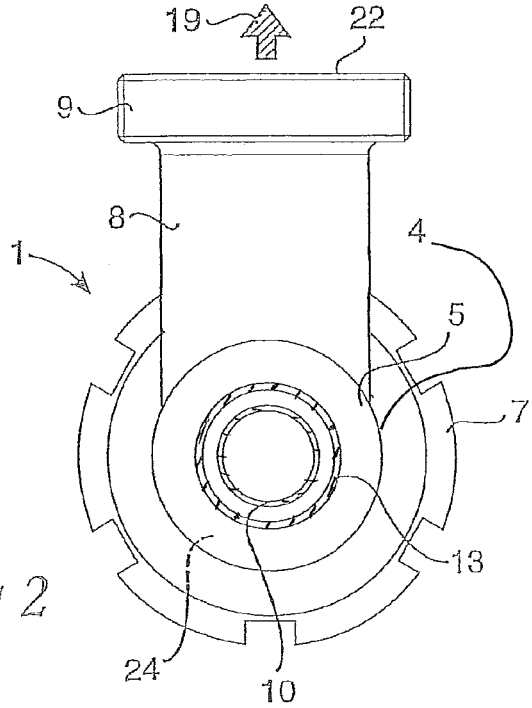

One preferred embodiment of the present invention will now be described in greater detail hereinbelow with reference to the accompanying Drawings. In the accompanying Drawings:

FIG. 1 shows, partly in section, a side elevation of the apparatus according to the present invention; and FIG. 2 is a cross section through the apparatus according to the present invention.

The accompanying Drawings show only those parts and details essential to an understanding of the invention, and the positioning of the apparatus in a full-scale plant, which is well-known to a person skilled in the art, has been omitted.

DESCRIPTION OF PREFERRED EMBODIMENT

The accompanying Drawings show an apparatus 1 which may be employed for mixing two flow, a first, larger flow 2 and a second, smaller flow 3. The first flow 2 may, for example, consist of water and the second flow 3 may be a fruit juice with or without fibres. The flows 2, 3 are shown in FIG. 1 by means of arrows.

The apparatus 1 includes a T pipe 4 which is placed at that point in a plant where the intention is to mix two flows. The T pipe 4 may consist of a standard T pipe which is modified in order to be able to be employed as a mixer. Such a T pipe 4 may, in principle, be described as consisting of a pipe length 5 with a connection in each end, a first connection 6 and a second connection 7. The first connection 6 and the second connection 7 are thus disposed at 180° in relation to one another. On the pipe length 5, an additional pipe length 8 is fixedly welded at 90° in relation to the first pipe length 5. The fixedly welded pipe length 8 also has, in its end, a connection 9 which constitutes the third connection of the T pipe 4.

The first connection 6 on the T pipe 4 constitutes an inlet 20 for the first, larger flow 2. That conduit (not shown) which leads the flow 2 in to the connection 6 has the same diameter as the pipe length 5 in the T pipe 4. In the first connection 6, there is disposed a conical portion 10 which is positioned in the connection 6 so that it constitutes a throttle for the flow 2. The conical portion 10 has, in its major end 14, a straight section 11 in which a number of holes 12 are provided. Alternatively, the conical portion 10 has no straight section 11 so that the holes 12 are provided direct in the major end 14 of the conical portion 10. The holes 12 are uniformly placed throughout the circumference of the conical portion 10 and have a diameter of 2-5 mm. The number of holes 12 may be from five to fifteen, depending upon their diameter.

The second connection 7 on the T pipe 4 constitutes an inlet 21 for the second, smaller flow 3. The second, smaller flow 3 enters into the apparatus 1 in a conduit 13 which is of smaller diameter than the pipe length 5 in the T pipe 4. The conduit 13 for the smaller flow 3 passes the connection 7 straight through a part of the pipe length 5 and terminates just before reaching the minor end 15 of the conical portion 10. The distance between the minor end 15 of the conical portion 10 and the end 16 of the conduit 13 is from 0 to 10 mm.

A part 17 of the pipe length 5 which is located between the pipe length 8 and the second connection 7 is greatly shortened in relation to a part 18 of the pipe length 5 which is located between the pipe length 8 and the first connection 6, as is apparent from FIG. 1. The connection 7 is sealed against the T pipe 4 by means of a soft seal 23 which is clamped between the pipe length 5 in the T pipe 4 and the connection 7. In that the soft seal 23 is clamped, it swells out against the interior of the pipe length 5 and forms a gently rounded surface against the flows 2, 3 in the apparatus 1.

The third connection 9 on the T pipe 4 constitutes, together with the pipe length 8, an outlet 22 for a flow 19 which consists of the mixed flows 2 and 3. The outlet 22 of the apparatus 1 is thus placed at 90° in relation to the two inlets 20, 21.

As is shown in FIG. 2, the diameter of the conduit 13 should be selected so that it is no more than 60% of the diameter of the pipe length 5. If stainless steel standard pipes are selected which are normally employed within the dairy industry, this corresponds to a diameter Ø38 mm for the conduit 13 and a diameter Ø51 mm for the pipe length 5. The smallest end 15 of the conical portion 10 should correspondingly have a diameter which constitutes approximately 50% of the diameter of the conduit 13. A corresponding diameter in standard piping will then be Ø25 mm for the smallest end 15 of the conical portion 10. Other diameters and dimensions may also occur, depending upon practical application.

The first, larger flow 2 enters into the apparatus 1 through the inlet 20, and the flow 2 is there directly divided up into a central flow which passes the conical portion 10 and, in such instance, is throttled so that the flow rate of flow 2 increases. The remaining flow passes into a number of smaller flows through the holes 12 which are provided in the conical portion 10.

The flow 2 meets the second, smaller flow 3 which enters into the apparatus 1 through the conduit 13. The two counter directed flows 2, 3 converge in a manner similar to an annular gap, at the same time as the minor flows from the holes 12 assist in mixing the two flows 2, 3 together. The flows from the holes 12 also assist in rinsing off any possible fibres so that they do not adhere in the apparatus 1.

Once the two flows 2, 3 have converged and a first mixing takes place, the two flows continue together into the space 24 between the conduit 13 and the pipe length 5. They are there forced shortly to change direction, the final mixing taking place and the intermixed flow 19 continuing out through the pipe length 8 and the outlet 22 for further transport through the plant (not shown), int. al. to a refractometer and to further processing of the product.

Since the part 17 of the pipe length 5 is shortened and the seal 23 forms a gentle transition between the pipe length 5 and the connection 7, there is nowhere on the path of the flow 19 out from the apparatus 1 where fibres may fasten. The apparatus 1 consequently will be simpler to clean than prior art apparatuses for mixing, which entails that it is possible to place higher demands on the hygienic standard of the apparatus 1. In cleaning, the holes 12 in the conical portion 10 also contribute in facilitating easier rinsing off residual product.

As will have been apparent from the foregoing description, the present invention realises an apparatus which simply and efficiently may mix flows which contain fibres without the fibres fastening in the apparatus. As a result of the design of the apparatus, a mixer will be obtained which may more readily be cleaned and, as a result, satisfies more stringent standards of hygiene.

What is claimed is:

1. An apparatus for continuous mixing of two flows, the flows comprising a first, larger flow and a second, smaller flow, the apparatus comprising a T pipe, where a first connection constitutes an inlet for the first flow and a second connection, at 180° in relation to the first, constitutes an inlet for the second flow, said second flow being led into the first flow through a conduit within the T pipe, and a third connection, at 90° in relation to both of the other connections constituting an outlet for the mixed flows wherein the first connection for the first flow is provided with a conical portion in which are provided a number of holes.

2. The apparatus as claimed in claim 1, wherein the minor end of the conical portion has a diameter which is approximately 50% of the diameter of the conduit.

3. The apparatus as claimed in claim 2, wherein the minor end of the conical portion and the end of the conduit are located 0-10 mm from one another.

4. The apparatus as claimed in claim 3, wherein conical portion has, in its major end, a straight section in which the holes are provided.

5. The apparatus as claimed in claim 3, wherein the holes are between five and fifteen in number, each having a diameter of 2-5 mm.

6. The apparatus as claimed in claim 2, wherein the conical portion has, in its major end, a straight section in which the holes are provided.

7. The apparatus as claimed in claim 2, wherein the holes are between five and fifteen in number, each having a diameter of 2-5 mm.

8. The apparatus (1) as claimed in claim 1, wherein the conical portion has, in its major end, a straight section in which the holes are provided.

9. The apparatus as claimed in claim 8, wherein the holes are between five and fifteen in number, each having a diameter of 2-5 mm.

10. The apparatus as claimed in claim 1, wherein the holes are between five and fifteen in number, each having a diameter of 2-5 mm.

11. A method of continuously mixing two flows comprising:

introducing a first flow traveling in one direction into a second flow traveling in an opposite direction to the one direction to effect mixing together of the first and second flows and create mixed flows;

immediately before the mixing of the first and second flows, a part of the first flow is throttled to produce a throttled part of the first flow and a remaining part of the first flow is divided into a plurality of subflows of the first flow, the throttled part of the first flow and the subflows of the first flow being mixed together with the second flow; and the mixed flows immediately changing direction after the mixing.

12. The method according to claim 11, wherein the remaining part of the first flow passes through a plurality of through holes to divide the remaining part of the first flow into the plurality of subflows.

13. The method according to claim 11, wherein the first flow is a first liquid and the second flow is a second liquid, the remaining part of the first flow of the first liquid passing through a plurality of spaced through holes to divide the remaining part of the first flow of the first liquid into the plurality of subflows of the first liquid.

14. The method according to claim 11, wherein the first and second flows are each a liquid.

15. The method according to claim 11, wherein the part of the first flow is throttled by passing the part of the first flow through a conical portion.

16. The method according to claim 11, wherein the remaining part of the first flow passes through a plurality of spaced apart through holes that divide the remaining part of the first flow into the plurality of subflows.

* * * * *